United States Patent [19]

Ootaki et al.

[11] 3,986,677

[45] Oct. 19, 1976

[54] TOILET PAPER-HOLDER

[75] Inventors: Kiyoshi Ootaki; Isamu Takada, both of Osaka, Japan

[73] Assignee: Kiyoshi Ootaki, Osaka, Japan

[22] Filed: June 26, 1975

[21] Appl. No.: 590,563

[30] Foreign Application Priority Data

Sept. 3, 1974 Japan ..... 49-105874

[52] U.S. Cl. ..... 242/55.53

[51] Int. Cl.[2] ..... B65H 19/00

[58] Field of Search ..... 242/55.2, 55.3, 55.53, 242/129.5, 129.51, 129.53, 68.4; 312/39, 40; 225/46, 47

[56] References Cited

UNITED STATES PATENTS

| | | | |
|---|---|---|---|
| 3,220,660 | 11/1965 | Bolger | 242/55.53 |
| 3,278,129 | 10/1966 | Bolger | 242/55.53 |
| 3,408,125 | 10/1968 | Rasmussen | 312/39 |
| 3,729,145 | 4/1973 | Koo et al. | 242/55.53 |
| 3,865,295 | 2/1975 | Okamura | 225/47 |

*Primary Examiner*—Leonard D. Christian
*Attorney, Agent, or Firm*—Browdy and Neimark

[57] ABSTRACT

A toilet-paper dispenser which has particular utility in public lavatories. The dispenser contains a holder for a first toilet roll which is presently being used as well as a compartment for a second replacement roll. When the toilet paper on the first roll is exhausted, a handle is pushed which automatically ejects the spent toilet roll shaft and simultaneously mounts the replacement roll for use.

7 Claims, 5 Drawing Figures

TOILET PAPER-HOLDER

FIELD OF THE INVENTION

The present invention relates to an easily exchangeable toilet paper-holder, and more particularly to an improved toilet paper-holder which can remove the shaft of the used toilet paper and mount a spare toilet paper readily, by only pushing down the handle.

BACKGROUND OF THE INVENTION

The toilet paper-holder heretofore in use holds only one roll of toilet paper at time, and is very troublesome when the used toilet paper roll must be replaced with a new one. Thus, there has been a need for an easily exchangeable toilet paper-holder, especially for use in public lavatories for a long time.

SUMMARY OF THE INVENTION

It is accordingly an object of the present invention to overcome the defects of the prior art as indicated above.

Another object of the present invention is to provide a new and improved toilet paper dispenser.

Yet another object of the present invention is to provide a toilet paper dispenser which can eject a spent toilet paper roll shaft.

Still another object of the present invention is to provide a toilet paper dispenser which automatically replaces a spent toilet roll shaft with a replacement roll.

These and other objects of this invention are accomplished by the present toilet-paper dispenser which consists of a housing enclosed by a durable cover. The housing contains a holder which allows toilet paper to be dispensed from a first toilet-paper roll as well as a compartment directly above the holder for the storage of a second replacement roll of toilet paper. When the toilet paper of the first roll is exhausted, the user pushes a handle which automatically ejects the spent toilet roll shaft and simultaneously mounts the replacement roll for use.

DETAILED DESCRIPTION OF THE INVENTION

Figure 1:
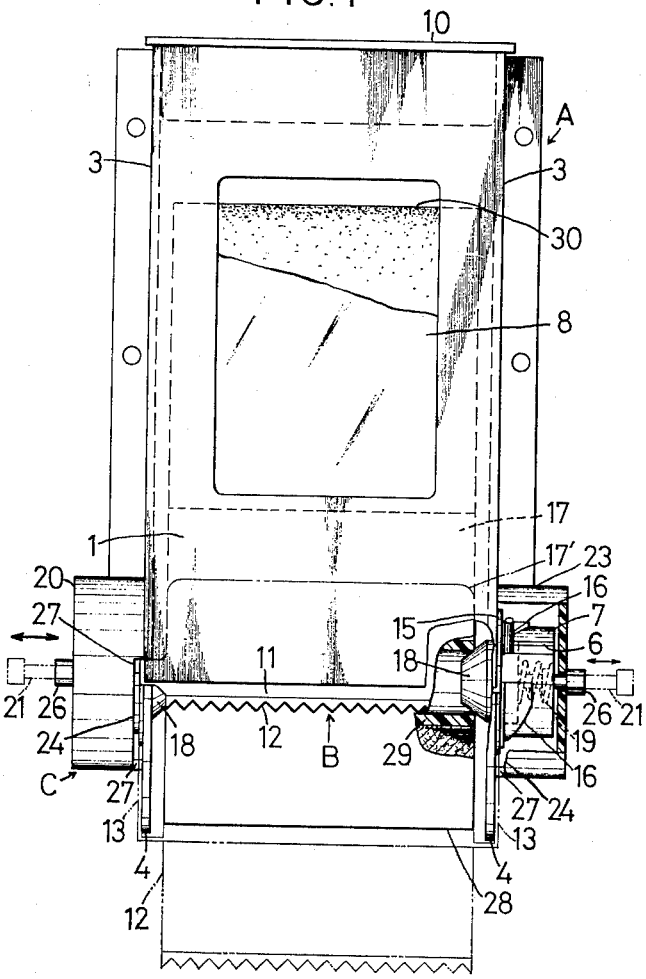
FIG. 1 is an elevational view partly in section.
Figure 4:
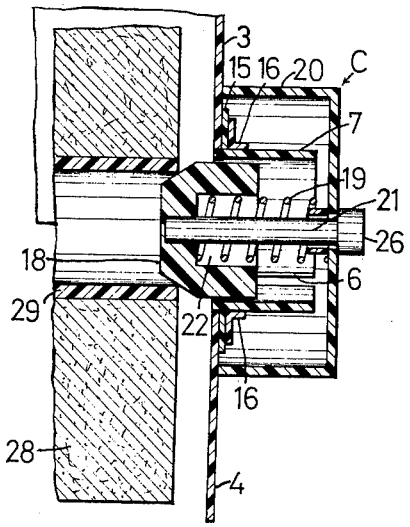
FIG. 4 is a partially sectional view to show the toilet paper in use.

The present invention consists of a holder body A, an operating rotation part B, and a paper holding part C. Said holder body A is a nearly square tube in which the upper and bottom sides are opened, and with the bottom portions of the front side 1 and the back side 2 shorter than both side walls 3,3 substantially semicircular plates 4,4 are provided at the bottom portions of the side walls 3,3, with the distance between the nearly semicircular plates 4,4 being slightly narrower than the width of the front side 1. An inserting opening 5 is provided at the center of the substantially semicircular plates 4,4 to insert and bond a cylindrical ring 7 having a deep incision 6,6, cut lengthwise, into said inserting opening 5 at the opposite position of both side walls.

A transparent window 8 can be provided at one portion of the front side 1, which can be constituted of an upper end-opened double wall composition in order to form a holder for an advertisement 9 at the rear side of the transparent window 8.

Furthermore, an ashtray 10 which is used as a cover can be provided at the upper opening.

The operating rotation part B has a handle 12 having a serrated edge projecting forward at the bottom end of the front portion 11, with both sides of the front portion 11 being bent at right angles to provide a side portion 13, on which an annular portion 15 having an opening 14 for the cylindrical ring 7 located at the bottom of the side wall 3 of the holder body A. Guide walls 16,16, having nearly the same curvature as the opening 14 and having its upper end cut obliquely, are provided on said annular portion 15 at the periphery of the opening 14 in the symmetrical position in respect of the center of the opening 14. Furthermore, a circularly curved plate 17 describing an angle of nearly 90° is provided at the front portion 11 of the rotation part B. This plate curves inwardly and has a short loading portion 17' for the spare toilet paper bent slightly upward provided at its end.

The paper holding part C consists of a roll shaft holder 18, a spring 19, a cover 20, and a shaft 21. The roll shaft holder 18 has a tapered frusto-conical portion at one end and a cylindrical portion having an opening 22 at its other end, the cylindrical portion being provided with pins 23,23 at the opposite position on its periphery. The cover 20 is a base-attached cylinder having a narrow incision 24 of about one fourth of the circumference at its periphery and an opening 25 for inserting the shaft 21 at the base. The shaft 21 is bolt shaped, having an enlarged head 26. The spring 19 is put in an opening 22 of the roll shaft holder 18. The shaft is inserted into an opening 25 of the cover 20 so that the bottom of the head 26 contacts with the outer surface of the base of the cover 20. The shaft 21 is inserted into the spring 19 to screw or bond to the bottom of the opening 22 of the roll shaft holder 18.

A process for assembling the present invention is described as follows.

The present invention comprises putting the curved plate 17 of the operating rotation part B in the holder body A, inserting the cylindrical rings 7,7 in the opening 14 at the both sides of the holder body A so to rotatably mount the operating rotation part B on the holder body A. The pins 23,23 are inserted in the incision 6,6 of the cylindrical ring 7, and the roll shaft holder 18 is introduced into the cylindrical ring 7. The paper holding parts C are mounted on the holder body A so that the cover 20 is bonded to the side walls 3,3 of the holder body A by placing the side portion 13 of the operating rotation part B between the incision 24 and the side wall 3 of the holder A and contacting the ends 27,27 of the incision 24 with the upper and bottom ends of the side portion 13 of the operating rotation part B to play the role as a stopper when rotating the operating rotation part B.

On assembling, in the state in which the upper end of the side portion 13 of the operating rotation part B contacts with the end 27 of the incision 24 of the cover 20, that is, in the state before the operating rotation part B rotates downward, pins 23,23 of the paper holding part C contact the bottom of the deep incision 6,6 of the cylindrical ring 7 by the resilient power of the spring 19, and, thus, both of the roll shaft holders 18,18 face each other at a distance which can hold the roll shaft 29 of the toilet paper 28.

The present invention is used as follows.

Figure 2:
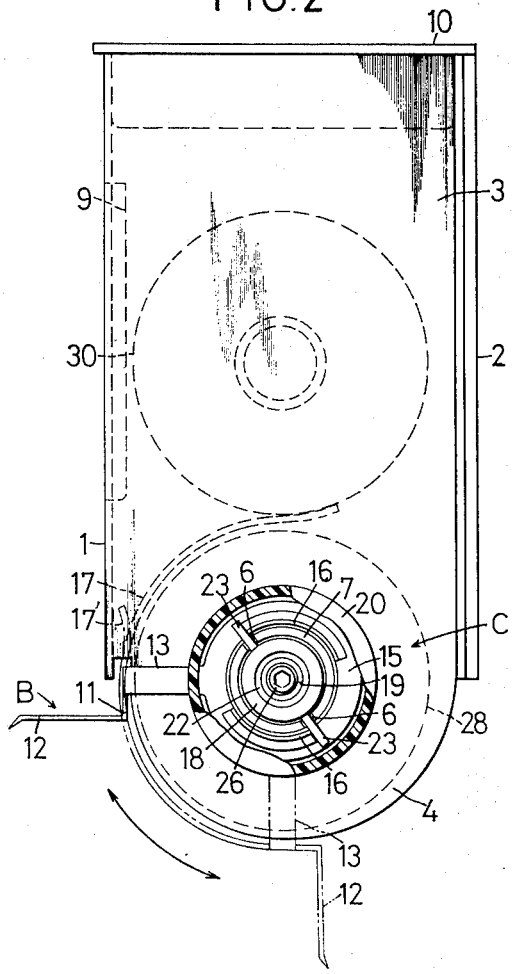
FIG. 2 is a right side elevational view partly in section.
Figure 3:
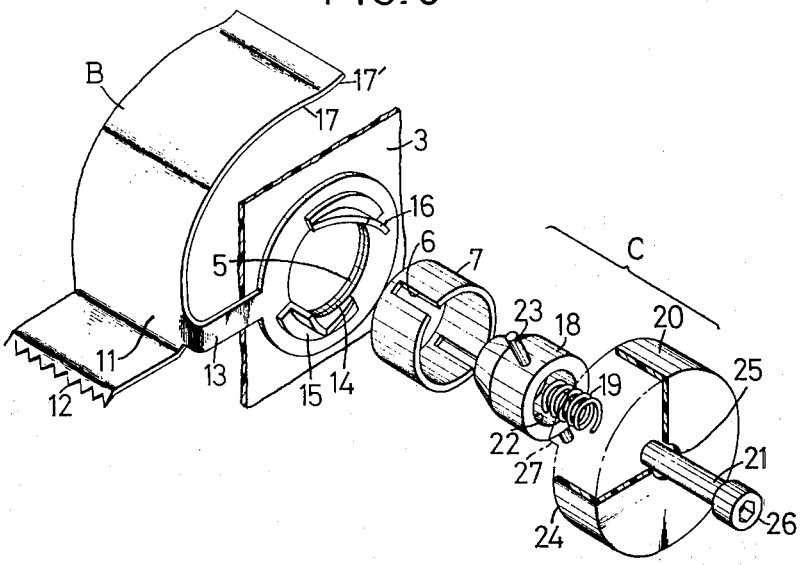
FIG. 3 is a perspective view to show the process for assembling.

Referring to FIGS. 1, 2, and 3, the tops of the tapered frusto-conical shaped roll shaft holder 18,18 of the paper holding part C push in the opening of the roll shaft 29 to hold the toilet paper 28, and the spare toilet paper 30 is placed on the spare toilet paper loading portion 17 at the end of the curved plate 17 of the operating rotation part B.

Figure 5:
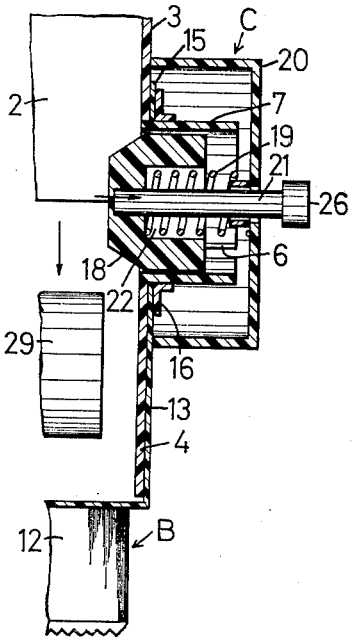
FIG. 5 is a partially sectional view to show the process for exchanging the toilet paper.

When the toilet paper 28 is exhausted, the handle 12 of the operating rotation part B is pushed downward, and the operating rotation part B is rotated until the bottom of the side portion 13 contacts with the end 27 of the incision 24 of the cover 20. The guide walls 16,16 of the annular portion 15 of the operating rotation part B enter between the annular portion 15 and pins 23,23, and the pins 23,23 slidably move outward in the deep incisions 6,6 of the cylindrical ring 7 against the spring 19. Thus, referring to FIG. 5, the roll shaft holders 18,18 move in the direction in which the distance between shaft holders 18,18 both becomes larger to release holding the roll shaft 29, and roll shaft 29 drops. At the same time, accompanied with rotation of the operating rotation part B, the spare toilet paper loading portion 17 releases to drop the spare toilet paper 30 allowing the spare toilet paper 30 to be accepted by the inner side of the curved plate 17, rotated downward and the roll shaft is ready to be put in by the roll shaft holders 18,18, in the position where the bottom of the side portion 13 contacts with the end 27 of the incision 24 of the cover 20.

When the handle 12 is released, the operating rotation part B rotates upward automatically, until the pins 23,23 slide on the upper side of the guide walls 16,16 and the upper side of the side portion 13 contacts with the end 27 of the incision 24 of the cover 20, because the pins 23,23 are pushed strongly against the guide walls 16,16 by the resilient power of the spring 19 and the upper sides of the obliquely cut guide walls 16,16. The roll shaft holder 18,18 returns to the original position, and the tops of the roll shaft holders 18,18 are put in the roll shaft of the spare toilet paper 30. Thus, the spare toilet paper is held to be used.

What is claimed is:

1. A paper dispenser allowing automatic ejection of spent paper roll shafts and replacing the old shafts with new rolls, comprising:

holder body means having two side members and front and back members for holding at least two rolls of paper vertically with respect to one another, said holder body means including two first apertures, one each of which are disposed in the bottom portion of each of said side members opposite from each other;

supporting means inserted through said front member to the inside of said holder body means for supporting at least one roll of paper;

handle means projecting from said supporting means outside of said holder body means for actuating the ejection of the old rolls and their replacement with new rolls, a portion of each side of said handle means being bent at right angles and each said side being provided with a second aperture which corresponds to one of said first apertures;

two rings, each of which pass through one of said first and the corresponding one of said second apertures, thereby allowing said handle means and said supporting means to rotate; and paper holder means inserted in and abutting each of said two rings for retaining a roll of paper, said paper holder means including a spring means for allowing axial movement of said paper holder means in response to the activation of said handle means;

whereby, when said handle means is depressed, said paper holder means are forced apart allowing the spent paper roll shaft to be ejected and, simultaneously, said supporting means allows a new roll to be released, and, when said handle means is released, said paper holder means is returned to its original position by the force of said spring means to hold the new roll of paper in place.

2. A paper dispenser according to claim 1 wherein said front and back members are shorter than said side members and wherein said side members terminate at the bottom in substantially semi-circular plates in which said first apertures are provided.

3. A paper dispenser according to claim 1 wherein each of said rings is provided with at least one slot and said paper holder means includes two shaft holders, each having a frusto-conical portion at one end and a cylindrical portion at the other end, said cylindrical portion provided with the same number of pins as the number of said slots in each of said rings.

4. A paper dispenser according to claim 3 further including a pair of symmetrically positioned obliquely cut guide walls encircling a portion of each of said second apertures and wherein said paper holder means further includes two cylindrical covers abutting the cylindrical portion of each of said shaft holders, each of said cylindrical covers having a narrow slot encircling approximately one quarter of its periphery and cooperating with said guide walls and said pins for releasing the spent paper roll and allowing said paper holder means to retain a new roll of paper.

5. A paper dispenser according to claim 1 wherein the end of said supporting means inserted in said holder body means is slightly curved upward.

6. A paper dispenser according to claim 1 wherein tissue paper is dispensed.

7. A paper dispenser according to claim 1 further including an ashtray on the top of said holder body means.

* * * * *